US010263376B1

(12) United States Patent
Brown

(10) Patent No.: US 10,263,376 B1
(45) Date of Patent: Apr. 16, 2019

(54) CONNECTOR CLEANER

(71) Applicant: Alton B. Brown, Newport News, VA (US)

(72) Inventor: Alton B. Brown, Newport News, VA (US)

( * ) Notice: Subject to any disclaimer, the term of this patent is extended or adjusted under 35 U.S.C. 154(b) by 25 days.

(21) Appl. No.: 15/495,839

(22) Filed: Apr. 24, 2017

Related U.S. Application Data

(60) Provisional application No. 62/326,868, filed on Apr. 25, 2016.

(51) Int. Cl.
*B24D 5/14* (2006.01)
*H01R 43/00* (2006.01)
*B08B 1/00* (2006.01)

(52) U.S. Cl.
CPC ..... *H01R 43/002* (2013.01); *B08B 1/001* (2013.01)

(58) Field of Classification Search
CPC B08B 1/001; B08B 1/00; B08B 1/002; B08B 1/003; B08B 1/005; B08B 1/006; H01R 43/002
USPC ..... 451/461; 15/105, 106, 118, 160, 210.1
See application file for complete search history.

(56) References Cited

U.S. PATENT DOCUMENTS 3,080,594 A * 3/1963 Race ..... B23K 3/08 15/210.1
3,343,245 A * 9/1967 Sylvester ..... B24D 15/04 407/29.11
3,504,459 A * 4/1970 Spiteri ..... H01R 9/00 451/525
3,719,460 A * 3/1973 Brockman ..... B24D 15/00 401/195
4,204,294 A * 5/1980 Halverson ..... A46B 5/0033 15/104.2
4,993,100 A * 2/1991 Halboth ..... A47L 25/00 15/104.94
5,029,417 A * 7/1991 Keller ..... B24D 15/082 451/461
5,144,775 A * 9/1992 Bakanowsky, III ..... H01R 43/002 15/210.1
5,890,252 A * 4/1999 Mellon ..... H01R 43/002 15/104.001
6,220,950 B1 * 4/2001 Novitsky ..... H01R 13/03 15/104.04
7,354,336 B1 * 4/2008 Lalancette ..... B24D 15/023 451/28
8,296,893 B2 * 10/2012 Vinci ..... B08B 9/021 15/104.001

(Continued)

*Primary Examiner* — George B Nguyen
(74) *Attorney, Agent, or Firm* — Shaddock Law Group, PC

(57) ABSTRACT

A connector cleaner having an elongate portion of material extending from a first end portion to a second end portion; a first paddle element extending from the first end portion, and wherein at least a portion of a first side surface of the first paddle element includes an abrasive element or portion; a second paddle element extending from the first end portion, wherein at least a portion of a first side surface of the second paddle element includes an abrasive element or portion, and wherein the first side surface of the first paddle element is positioned adjacent the first side surface of the second paddle element; and a singular paddle element extending from the second end portion of the elongate portion of material, and wherein at least a portion of a first side surface of the singular paddle element includes an abrasive element or portion.

20 Claims, 7 Drawing Sheets

(56) References Cited

U.S. PATENT DOCUMENTS

| | | | | |
|---|---|---|---|---|
| 2010/0281639 | A1* | 11/2010 | Vinci | H01R 43/002 15/104.001 |
| 2014/0289980 | A1* | 10/2014 | Vinci | H01R 43/002 15/105 |
| 2016/0036185 | A1* | 2/2016 | Vinci | H01R 43/002 134/8 |
| 2016/0135673 | A1* | 5/2016 | Miller | A61B 1/123 134/57 R |

* cited by examiner

CONNECTOR CLEANER

CROSS-REFERENCE TO RELATED APPLICATIONS

This patent application claims the benefit of U.S. Patent Application Ser. No. 62/326,868, filed Apr. 25, 2016, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of connector cleaners. More specifically, the presently disclosed systems, methods, and/or apparatuses relate to a connector cleaner adaptable to be used with various types of electrical or other connectors.

2. Description of Related Art

It is generally known that mating electrical connectors, such as, for example, male and female spade connectors can, over time develop corrosion on their surfaces, which can lead to complete or partial discontinuity of an electrical connection. If discontinuity occurs, the electrical connectors are typically disconnected and individually cleaned using solvents for other chemical or physical electrical parts cleaners. Once cleaned, the electrical connectors are rejoined.

So long as an effective amount of the corrosion has been removed, electrical continuity is returned to the electrical connection.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical connector cleaning devices and methods have various shortcomings. For example, certain connector configurations can include various areas with angles or portions that are difficult to reach or properly clean. In addition, present connector cleaning devices and methods can be tedious and produce inconsistent results. Furthermore, some electrical connections or components can be located in areas that make it difficult for someone to access and clean the electrical connector components in place, without removing them from an attached or connected device. For example, an electrical connector may be located in a confined space or a difficult to reach location in an automotive vehicle or a watercraft.

In various exemplary, non-limiting embodiments, the connector cleaner of the presently disclosed systems, methods, and/or apparatuses comprises an elongate portion of material extending from a first end portion to a second end portion; a first paddle element extending from the first end portion of the elongate portion of material, wherein the first paddle element comprises a substantially planar first side surface, and wherein at least a portion of the first side surface of the first paddle element includes an abrasive element or portion; a second paddle element extending from the first end portion of the elongate portion of material, wherein the second paddle element comprises a substantially planar first side surface, wherein at least a portion of the first side surface of the second paddle element includes an abrasive element or portion, and wherein the first side surface of the first paddle element is positioned adjacent the first side surface of the second paddle element; and a singular paddle element extending from the second end portion of the elongate portion of material, wherein the singular paddle element comprises a substantially planar first side surface, and wherein at least a portion of the first side surface of the singular paddle element includes an abrasive element or portion.

In various exemplary, nonlimiting embodiments, the elongate portion of material comprises a portion of a shaft or rod.

In various exemplary, nonlimiting embodiments, the abrasive element or portion comprises an abrasive portion of material attached or coupled to at least a portion of the first side surface of the first paddle element and at least a portion of the first side surface of the second paddle element.

In various exemplary, nonlimiting embodiments, the abrasive element or portion comprises an abrasive surface preparation of at least a portion of the first side surface of the first paddle element and at least a portion of the first side surface of the second paddle element.

In various exemplary, nonlimiting embodiments, the abrasive element or portion comprises an abrasive material attached or coupled to at least a portion of the first side surface of the first paddle element and at least a portion of the first side surface of the second paddle element.

In various exemplary, nonlimiting embodiments, the first side surface of the first paddle element is positioned adjacent the first side surface of the second paddle element such that at least a portion of the first side surface of the first paddle element is in contact with at least a portion of the first side surface of the second paddle element.

In various exemplary, nonlimiting embodiments, the first paddle element and the second paddle element are formed of a substantially rigid or substantially semi rigid material.

In various exemplary, nonlimiting embodiments, an abrasion gap is defined between the first side surface of the first paddle element and the first side surface of the second paddle element, wherein the first paddle element and the second paddle element are formed of a biasing material, such that when the first paddle element and the second paddle element are urged apart, expanding the abrasion gap, the first paddle element and the second paddle element provide a biasing force to contract the abrasion gap.

In various exemplary, nonlimiting embodiments, an illumination source is disposed proximate the first end portion of the elongate portion of material and/or proximate the second end portion of the elongate portion of material. In certain exemplary embodiments, an illumination source is disposed along the elongate portion of material and is rotatable such that the illumination source may be selectively, rotatable between an area proximate the first end portion of the elongate portion of material and an area proximate the second end portion of the elongate portion of material.

In various exemplary, non-limiting embodiments, the connector cleaner of the presently disclosed systems, methods, and/or apparatuses comprises an elongate portion of material extending from a first end portion to a second end portion; a first paddle element extending from the first end portion of the elongate portion of material, wherein the first paddle element comprises a substantially planar first side surface, and wherein at least a portion of the first side surface of the first paddle element includes an abrasive element or portion; and a second paddle element extending from the first end portion of the elongate portion of material, wherein the second paddle element comprises a substantially planar first side surface, wherein at least a portion of the first side surface of the second paddle element includes an abrasive element or portion, and wherein the first side surface of the first paddle element is positioned adjacent the first side surface of the second paddle element.

In various exemplary, non-limiting embodiments, the connector cleaner of the presently disclosed systems, methods, and/or apparatuses comprises a substantially electrically nonconductive cover material that covers at least a portion of a surface of the rod, the entire surface of the rod, at least a portion of the first paddle element and the second paddle element, and/or at least a portion of the singular paddle element.

Accordingly, the presently disclosed systems, methods, and/or apparatuses separately and optionally provide connector cleaning assemblies that allow a user to readily remove corrosion from or clean certain contact or other surfaces or portions of various connector elements.

The presently disclosed systems, methods, and/or apparatuses separately and optionally provide connector cleaning assemblies that allow a user to more easily reach difficult or hard-to-reach spaces to remove corrosion from or clean certain contact or other surfaces or portions of various connector elements.

The presently disclosed systems, methods, and/or apparatuses separately and optionally provide connector cleaning assemblies that provide adjacent abrasive surfaces for simultaneously removing corrosion from or cleaning opposing surfaces of connector elements.

The presently disclosed systems, methods, and/or apparatuses separately and optionally provide connector cleaning assemblies that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
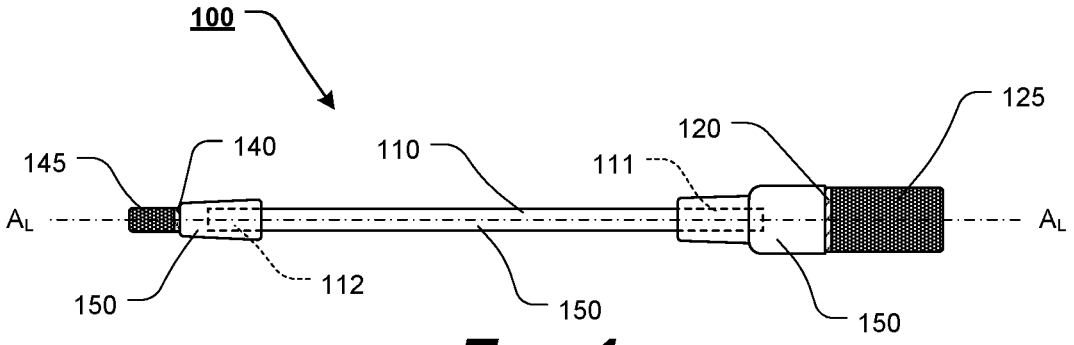
FIG. 1 illustrates a top view of an exemplary embodiment of the connector cleaner, according to the presently disclosed systems, methods, and/or apparatuses.
Figure 2:
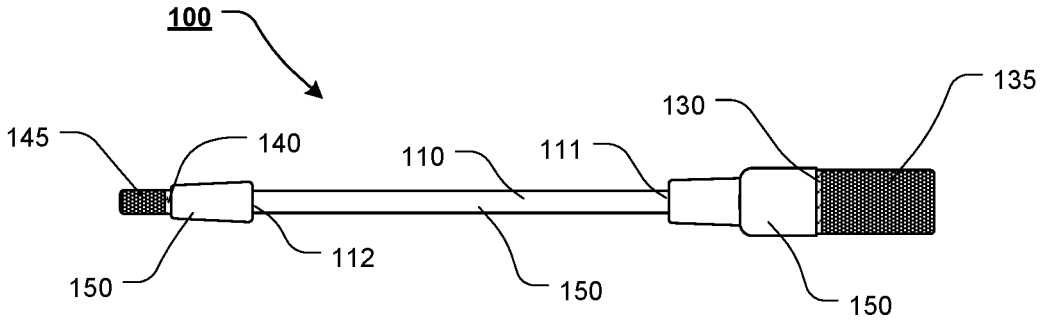
FIG. 2 illustrates a bottom view of an exemplary embodiment of the connector cleaner, according to the presently disclosed systems, methods, and/or apparatuses.
Figure 3:
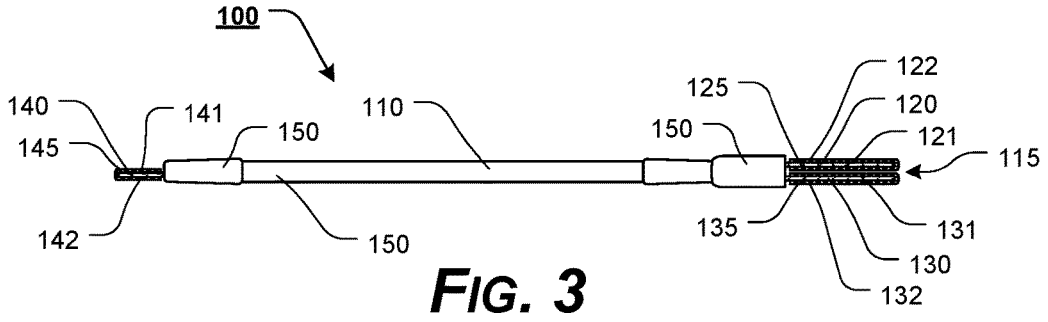
FIG. 3 illustrates a right side view of an exemplary embodiment of the connector cleaner, according to the presently disclosed systems, methods, and/or apparatuses.
Figure 4:
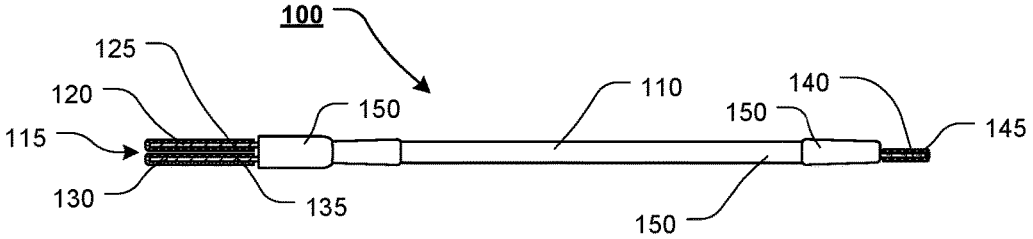
FIG. 4 illustrates a left side view of an exemplary embodiment of the connector cleaner, according to the presently disclosed systems, methods, and/or apparatuses.
Figure 5:
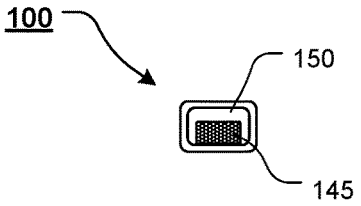
FIG. 5 illustrates a rear view of an exemplary embodiment of the connector cleaner, according to the presently disclosed systems, methods, and/or apparatuses.
Figure 6:
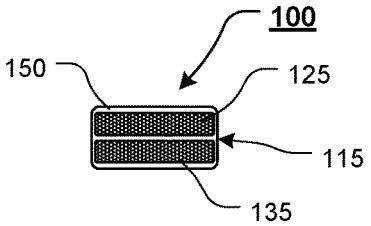
FIG. 6 illustrates a front view of an exemplary embodiment of the connector cleaner, according to the presently disclosed systems, methods, and/or apparatuses.
Figure 7:
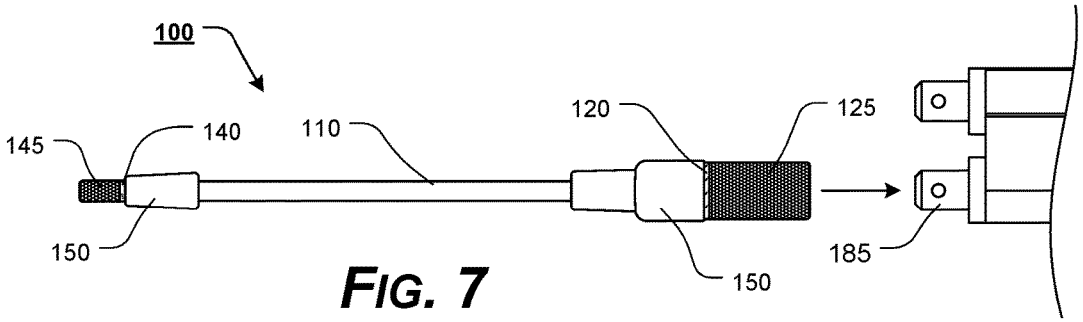
FIG. 7 illustrates a top view of an exemplary embodiment of the connector cleaner, being aligned with a male spade connector, according to the presently disclosed systems, methods, and/or apparatuses.
Figure 8:
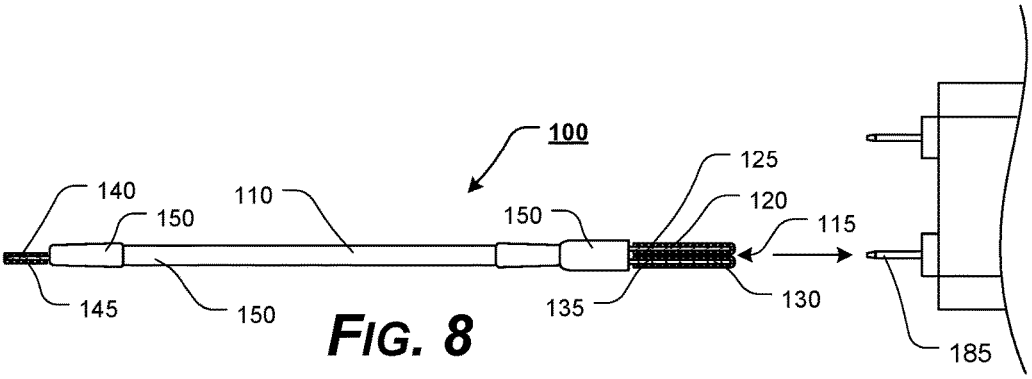
FIG. 8 illustrates a right side view of an exemplary embodiment of the connector cleaner, being aligned with a male spade connector, according to the presently disclosed systems, methods, and/or apparatuses.
Figure 9:
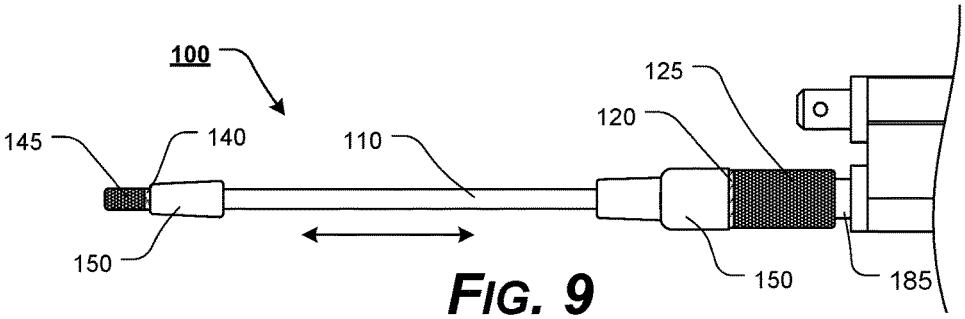
FIG. 9 illustrates a top view of an exemplary embodiment of the connector cleaner, being used to remove corrosion from or clean a male spade connector, according to the presently disclosed systems, methods, and/or apparatuses.
Figure 10:
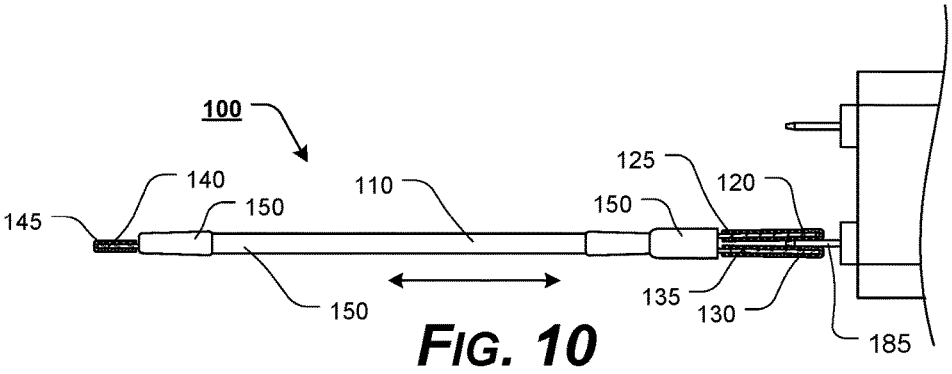
FIG. 10 illustrates a right side view of an exemplary embodiment of the connector cleaner, being used to remove corrosion from or clean a male spade connector, according to the presently disclosed systems, methods, and/or apparatuses.
Figure 11:
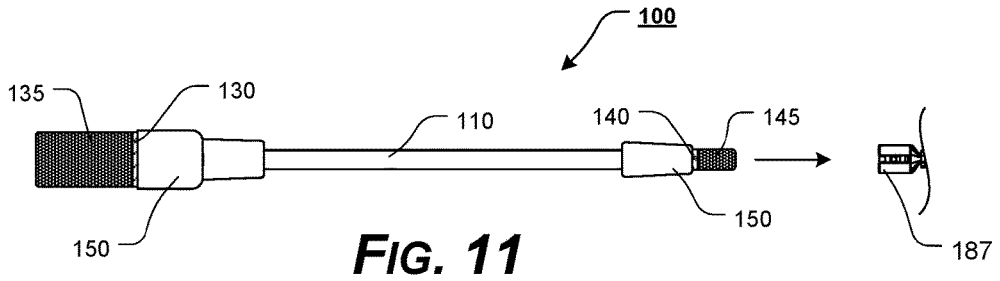
FIG. 11 illustrates a top view of a singular paddle element of an exemplary embodiment of the connector cleaner, being aligned with a female spade connector, according to the presently disclosed systems, methods, and/or apparatuses.
Figure 12:
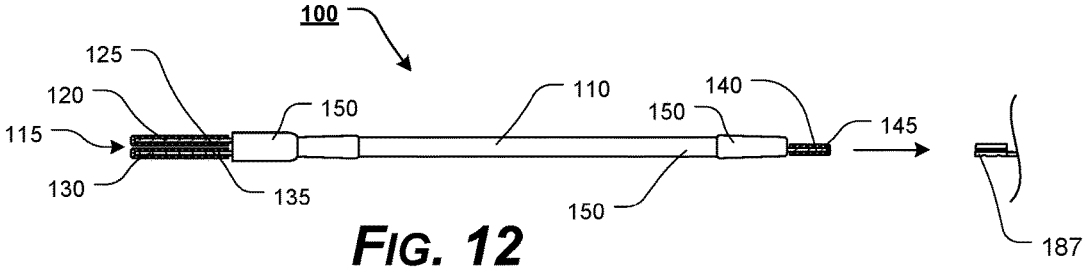
FIG. 12 illustrates a right side view of a singular paddle element of an exemplary embodiment of the connector cleaner, being aligned with a female spade connector, according to the presently disclosed systems, methods, and/or apparatuses.

For simplicity and clarification, the design factors and operating principles of the connector cleaner according to the presently disclosed systems, methods, and/or apparatuses are explained with reference to various exemplary embodiments of a connector cleaner according to the presently disclosed systems, methods, and/or apparatuses. The basic explanation of the design factors and operating principles of the connector cleaner is applicable for the understanding, design, and operation of the connector cleaner of the presently disclosed systems, methods, and/or apparatuses. It should be appreciated that the connector cleaner can be adapted to many applications where a connector cleaner can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "connector cleaner", "connector", "rod", and "paddle element" are used for basic explanation and understanding of the operation of the systems, methods, and apparatuses of the presently disclosed systems, methods, and/or apparatuses. Therefore, the terms "connector cleaner", "connector", "rod", and "paddle element" are not to be construed as limiting the systems, methods, and apparatuses of the presently disclosed systems, methods, and/or apparatuses.

For simplicity and clarification, the connector cleaner of the presently disclosed systems, methods, and/or apparatuses will be described as being used in conjunction with certain electrical connectors, such as, for example, male and female spade connectors. However, it should be appreciated that these are merely exemplary embodiments of the connector cleaner and are not to be construed as limiting the presently disclosed systems, methods, and/or apparatuses. Thus, the connector cleaner of the presently disclosed systems, methods, and/or apparatuses may be utilized in conjunction with any electrical or other connector element.

Turning now to the appended drawing figures, FIGS. 1-22 illustrate certain elements and/or aspects of an exemplary embodiment of the connector cleaner 100, according to the presently disclosed systems, methods, and/or apparatuses. In illustrative, non-limiting embodiment(s) of the presently disclosed systems, methods, and/or apparatuses, as illustrated in FIGS. 1-22, the connector cleaner 100 comprises a shaft or rod 110 comprising an elongate portion of material extending, along a longitudinal axis $A_L$, from a first end portion 111 to a second end portion 112.

In various exemplary embodiments, the rod 110 is substantially rigid and formed of wood or plastic. Alternate materials of construction of the rod 110 may include one or more of the following: wood, steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, polyvinyl chloride (PVC) and/or various combinations of the foregoing. Thus, it should be understood that the material or materials used to form the rod 110 is a design choice based on the desired appearance and functionality of the rod 110.

Thus, it should be appreciated and understood that the rod 110 may be formed of a material having electrically conductive, electrically insulating, or nonconductive, or electrically semi conductive properties.

In various exemplary embodiments, the rod 110 has an overall circular cross-sectional shape. However, it should be understood and appreciated that the overall cross-sectional shape of the rod 110 is a design choice and is not critical to the present disclosure. Thus, the rod 110 may have any desired overall cross-sectional shape.

Likewise, the overall length of the rod 110 is a design choice based upon the desired functionality and/or appearance of the rod 110 or the connector cleaner 100.

A first paddle element 120 and a second paddle element 130 are formed having substantially planar first side surfaces 121 and 131, respectively, and substantially planar second side surfaces 122 and 132, respectively.

The first paddle element 120 and the second paddle element 130 are each attached or coupled to the rod 110, such that each of the first paddle element 120 and the second paddle element 130 extend from the first end portion 111 of the rod 110. In this configuration, the first side surface 121 of the first paddle element 120 faces the first side surface 131 of the second paddle element 130, while the second side surface 122 of the first paddle element 120 faces away from the second side surface 132 of the second paddle element 130.

In certain exemplary embodiments, as illustrated, the first paddle element 120 and the second paddle element 130 are substantially rectangular. However, it should be appreciated that the overall size and shape of the first paddle element 120 and the second paddle element 130 is a design choice, based upon the desired appearance and/or functionality of the first paddle element 120 and the second paddle element 130.

In certain exemplary embodiments, the first paddle element 120 and the second paddle element 130 are substantially mirror images of one another. However, it should be appreciated that the first paddle element 120 and the second paddle element 130 may optionally comprise different overall sizes, shapes, or be formed of different compositions of material, when compared to one another.

In certain exemplary embodiments, the first paddle element 120 and the second paddle element 130 are comprised of a substantially rigid or substantially semi-rigid material, such as, for example, a substantially rigid or substantially semi-rigid metal, plastic, or composite material. In this manner, the first paddle element 120 and the second paddle element 130 may be at least somewhat resistant to flexing. Alternatively, the first paddle element 120 and the second paddle element 130 may comprise a biasing or resilient material, such as, for example, spring steel.

The first paddle element 120 and the second paddle element 130 are attached or coupled to the first end portion 111 of the rod 110 such that the first side surface 121 of the first paddle element 120 is positioned adjacent to the first side surface 131 of the second paddle element 130. In various exemplary, nonlimiting embodiments, an abrasion gap 115 is defined between the first side surface 121 of the first paddle element 120 and the first side surface 131 of the second paddle element 130.

In various exemplary, nonlimiting embodiments, the first side surface of the first paddle element 120 is positioned adjacent the first side surface 131 of the second paddle element 130 such that at least a portion of the first side surface 121 of the first paddle element 120 is in contact with at least a portion of the first side surface 131 of the second paddle element 130, thereby being presented with a minimal abrasion gap 115.

Thus, the first paddle element 120 and the second paddle element 130 are attached or coupled to the rod 110 such that when the first paddle element 120 and the second paddle element 130 are urged apart, expanding the abrasion gap 115, the first paddle element 120 and the second paddle element 130 provide a biasing force to purge the first side surface 121 of the first paddle element 120 toward the first side surface of the second paddle element 130, in an effort to reduce the abrasion gap 115.

A singular paddle element 140 is formed having at least a substantially planar first side surface 141 and a second side surface 142. The singular paddle element 140 is attached or coupled to the rod 110, such that the singular paddle element 140 extends from the second end portion 112 of the rod 110. In certain exemplary embodiments, as illustrated, the singular paddle element 140 is substantially rectangular. However, it should be appreciated that the overall size and shape of the singular paddle element 140 is a design choice, based upon the desired appearance and/or functionality of the first paddle element 120 and the second paddle element 130.

Figure 13:
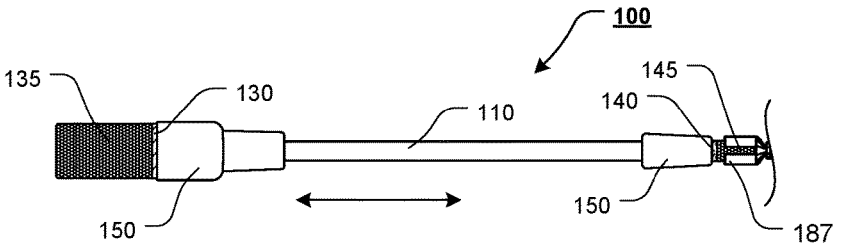
FIG. 13 illustrates a top view of a singular paddle element of an exemplary embodiment of the connector cleaner, being used to remove corrosion from or clean a female spade connector, according to the presently disclosed systems, methods, and/or apparatuses.
Figure 14:
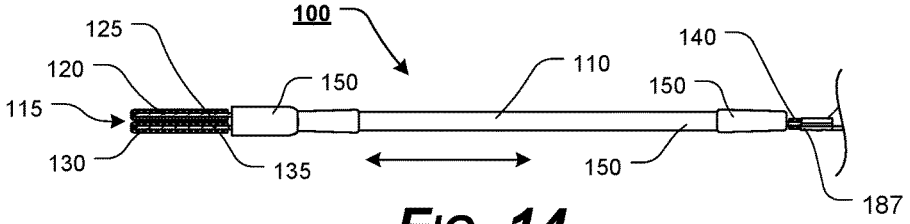
FIG. 14 illustrates a right side view of a singular paddle element of an exemplary embodiment of the connector cleaner, being used to remove corrosion from or clean a female spade connector, according to the presently disclosed systems, methods, and/or apparatuses.
Figure 15:
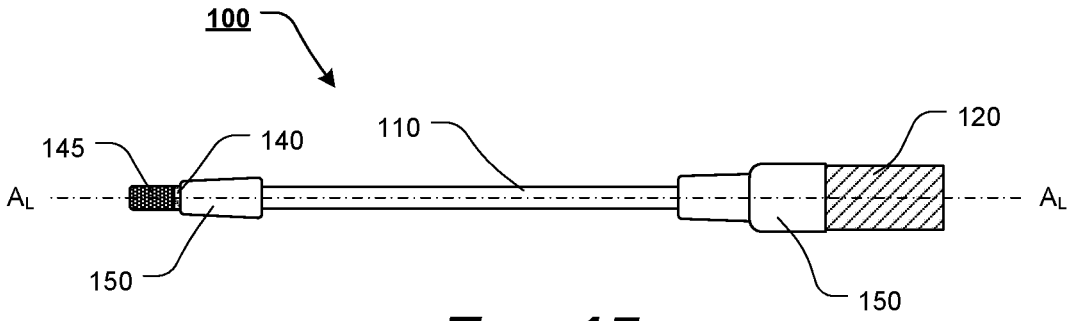
FIG. 15 illustrates a top view of an exemplary embodiment of the connector cleaner, according to the presently disclosed systems, methods, and/or apparatuses.
Figure 16:
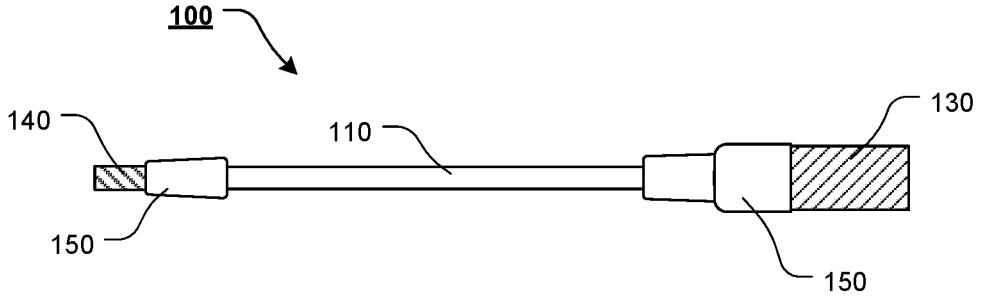
FIG. 16 illustrates a bottom view of an exemplary embodiment of the connector cleaner, according to the presently disclosed systems, methods, and/or apparatuses.
Figure 17:
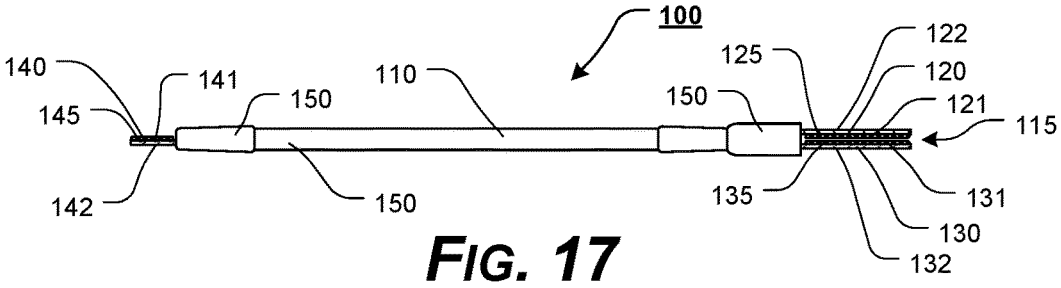
FIG. 17 illustrates a right side view of an exemplary embodiment of the connector cleaner, according to the presently disclosed systems, methods, and/or apparatuses.
Figure 18:
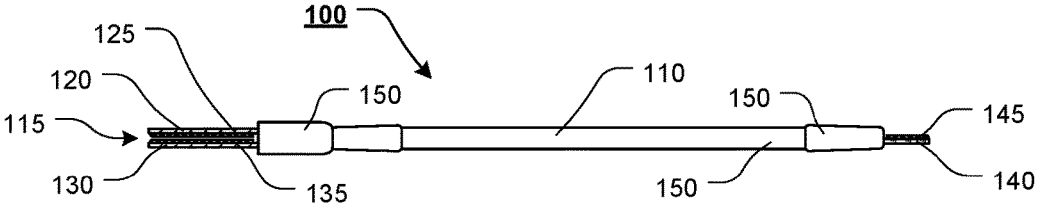
FIG. 18 illustrates a left side view of an exemplary embodiment of the connector cleaner, according to the presently disclosed systems, methods, and/or apparatuses.
Figure 19:
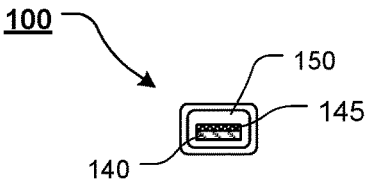
FIG. 19 illustrates a rear view of an exemplary embodiment of the connector cleaner, according to the presently disclosed systems, methods, and/or apparatuses.
Figure 20:
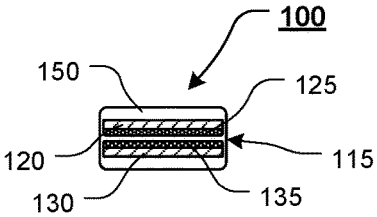
FIG. 20 illustrates a front view of an exemplary embodiment of the connector cleaner, according to the presently disclosed systems, methods, and/or apparatuses.

In certain exemplary, nonlimiting embodiments, the singular paddle element 140 is formed so as to be at least partially insertable within a female spade connector 187, as illustrated in FIGS. 13-14.

In certain exemplary embodiments, the singular paddle element 140 is comprised of a substantially rigid or substantially semi-rigid material, such as, for example, a substantially rigid or substantially semi-rigid metal, plastic, or composite material. In this manner, singular paddle element 140 may be at least somewhat resistant to flexing. Alternatively, the singular paddle element 140 may comprise a biasing or resilient material, such as, for example, spring steel.

In various exemplary embodiments, the singular paddle element 140 comprises at least a substantially planar first side surface 141.

As illustrated, suitable materials can be used and sections or elements of the connector cleaner 100 made independently and attached or coupled together, such as by adhesives, welding, screws, rivets, pins, or other fasteners, to form the various elements of the connector cleaner 100. Alternatively, it should be appreciated that certain elements of the connector cleaner 100 may be formed as an integral unit. For example, at least some of the rod 110, the first paddle element 120, the second paddle element 130, and/or the singular paddle element 140 may be formed as an integral unit. If formed as an integral unit, at least portions of the first paddle element 120 and the second paddle element 130 may optionally be at least substantially resilient, such that when the first side surface of the first paddle element 120 and the first side surface of the second paddle element 130 are urged apart, expanding the abrasion gap 115, the natural bias of the first paddle element 120 and the second paddle element 130 tends to urge the first side surface of the first paddle element 120 and the first side surface of the second paddle element 130 toward one another.

At least a portion of the first side surface 121 of the first paddle element 120, the first side surface 131 of the second paddle element 130, and the first side surface 141 of the singular paddle element 140 includes an abrasive element or portion. For example, as illustrated most clearly in FIGS. 15-20, a first abrasive element 125 is formed on at least a portion of the first side surface 121 of the first paddle element 120. In certain exemplary embodiments, as illustrated most clearly in FIGS. 1-6, the first abrasive element 125 is formed on at least a portion of the first side surface 121 and at least a portion of the second side surface 122 of the first paddle element 120. Similarly, a second abrasive element 135 is formed on at least a portion of the first side surface 131 of the second paddle element 130. In certain exemplary embodiments, the second abrasive element 135 is formed on at least a portion of the first side surface 131 and at least a portion of the second side surface 132 of the second paddle element 130.

In certain exemplary embodiments, as illustrated most clearly in FIGS. 15-20, a singular abrasive element 145 is formed on at least a portion of the first side surface 141 of the singular pad element 140. In certain exemplary embodiments, as illustrated most clearly in FIGS. 1-6, the singular abrasive element 145 is formed on at least a portion of the first side surface 141 and at least a portion of the second side surface 142 of the singular paddle element 140.

In various exemplary embodiments, each abrasive element or portion 125, 135, and/or 145 is created by one or more surface preparations formed on or in at least a portion of the first side surface 121 of the first paddle element 120, the first side surface 131 of the second paddle element 130, and the first side surface 141 of the singular paddle element 140. Alternatively, each abrasive element or portion 125, 135, and/or 145 is created by one or more layers of abrasive material or materials (such as, for example, naturally occurring or synthetic diamond particles, sand, powdered glass, emery, crystalline aluminum oxide, corundum, hematite, magnetite, silicon carbide, and the like) coating, covering, adhesively affixed to, or impregnating at least a portion of the first side surface 121 of the first paddle element 120, the first side surface 131 of the second paddle element 130, and the first side surface 141 of the singular paddle element 140.

In still other exemplary embodiments, each abrasive element or portion 125, 135, and/or 145 is created by a portion of emery paper, sandpaper, or other abrasive paper, cloth, or fabric being attached or coupled (such as, for example, adhesively) to at least a portion of the first side surface of the first paddle element 120, the first side surface of the second paddle element 130, and/or the first side surface of the singular paddle element 140, respectively. In certain exemplary, nonlimiting embodiments, the abrasive element or portion is created by portions of 80-200 grit sandpaper or emery cloth being adhesively attached to at least a portion of the first side surface of the first paddle element 120, the first side surface of the second paddle element 130, and the first side surface of the singular paddle element 140, respectively.

It should be appreciated that the material or materials used to form the abrasive element or portion may be any abradant, abrasive, abrasive material, or substance that can be used to abrade (remove material from or wear down by or through, for example, physical contact or rubbing) surfaces or mechanically finish a surface.

In various exemplary embodiments, each abrasive element or portion 125, 135, and/or 145 is included on at least a portion of a second side surface 122 of the first paddle element 120, a second side surface 132 of the second paddle element 130, and optionally a second side surface 141 of the singular paddle element 140. If the abrasive element or portion 125, 135, and/or 145 is included on one or more of the second side surface 122 of the first paddle element 120, the second side surface 132 of the second paddle element 130, and/or the second side surface 142 of the singular paddle element 140, the additional abrasive element or portion can be utilized to abrade surfaces or mechanically finish surfaces that may not easily come into contact with or be abraded by the abrasive element or portion of the first side surface 121 of the first paddle element 120, the first side surface 131 of the second paddle element 130, or the first side surface 141 of the singular paddle element 140. Thus, additional abrasive surfaces may optionally be provided to the connector cleaner 100.

In various exemplary embodiments, a cover material 150 covers at least a portion of a surface of the rod 110. In certain other exemplary embodiments, the cover material 150 covers the entire surface of the rod 110. In still other exemplary embodiments, the cover material 150 covers at least a portion of the surface of the rod 110 (and optionally the entire surface of the rod 110) and at least a portion of the first paddle element 120 and the second paddle element 130. Optionally, the cover material 150 may also cover at least a portion of the singular paddle element 140.

In various exemplary embodiments the cover material 150 comprises a substantially electrically nonconductive material, such as, for example, a substantially plastic or rubber material. In certain exemplary embodiments, the cover material 150 comprises a shrink-wrap material that, when heated, can conform to the overall size and shape of the various components of the connector cleaner 100.

It should be understood that if the rod 110 and/or the first paddle element 120, the second paddle element 130, and/or the singular paddle element 140 are formed of electrically conductive materials, the electrically nonconductive cover material 150 can be used to form an electrical barrier between those electrically conductive elements and a user, thereby reducing the chance of potential electrical shock to a user.

As illustrated most clearly in FIGS. 7-10, during use, a male spade connector 185 can be inserted between the first side surface 121 of the first paddle element 120 and the first side surface 131 of the second paddle element 130, within the abrasion gap 115. As the male spade connector 185 is inserted between the first paddle element 120 and the second paddle element 130, the first paddle element 120 and the second paddle element 130 are urged apart. Because of the biasing of the first paddle element 120 and the second paddle element 130 toward one another, the first paddle element 120 and the second paddle element 130 provide a biasing force to contract the abrasion gap 115. Thus, each of the first side surface 121 of the first paddle element 120 and the first side surface 131 of the second paddle element 130 remain substantially in contact with opposing, corresponding side surfaces of the male spade connector 185.

In this manner, at least portions of the opposing side surfaces of the male spade connector 185 are each simultaneously contacted by portions of the first abrasive element 125 and the second abrasive element 135. Thus, as the male spade connector 185 is repeatedly moved in and out of the abrasion gap 115, the first abrasive element 125 and the second abrasive element 135 are simultaneously urged against the opposing side surfaces of the male spade connector 185 and the opposing side surfaces are abraded to remove corrosion or to generally clean the opposing side surfaces of the male spade connector 185 to increase the electrical conductivity of the male spade connector 185.

As illustrated most clearly in FIGS. 11-14, during use, at least a portion of the singular paddle element 140 is formed such that at least a portion of the singular paddle element 140 can be inserted within at least a portion of a female spade connector 187. As the singular paddle element 140 is inserted within at least a portion of the female spade connector 187, at least a portion of the singular abrasive element 145 of the singular paddle element 140 comes into contact with an interior side surface of the female spade connector 187.

In this manner, at least a portion of the interior side surface of the female spade connector 187 is contacted by portions of the singular abrasive element 145 of the singular paddle element 140. Thus, as the singular paddle element 140 is repeatedly moved in and out of the female spade connector 187, the singular abrasive element 145 is urged against the interior side surface of the female spade connector 187 and the interior side surface is abraded to remove corrosion or to generally clean the interior side surface of the female spade connector 187 to increase the electrical conductivity of the female spade connector 187.

Thus, the presently disclosed systems, methods, and/or apparatuses separately and optionally provide connector cleaning assemblies that allow a user to more easily reach difficult or hard-to-reach spaces to remove corrosion from or clean certain contact or other surfaces or portions of various male and female connector elements.

It should also be appreciated that a more detailed explanation of the construction of the male spade connector 185 and the female spade connector 187, instructions regarding how to use male spade connectors 185 and female spade connectors 187, and certain other items and/or techniques necessary for the implementation and/or operation of the various exemplary embodiments of the presently disclosed systems, methods, and/or apparatuses are not provided herein because such elements are commercially available and/or such background information will be known to one of ordinary skill in the art. Therefore, it is believed that the level of description provided herein is sufficient to enable one of ordinary skill in the art to understand, construct, and use the systems, methods, and/or apparatuses, as described herein.

Figure 21:
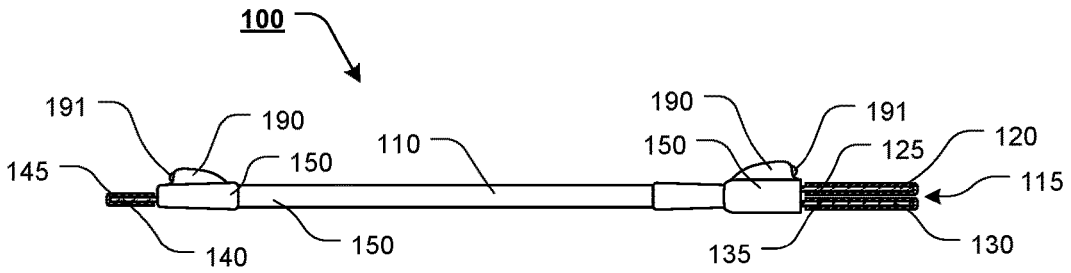
FIG. 21 illustrates a right side view of an exemplary embodiment of the connector cleaner, including two exemplary illumination sources, according to the presently disclosed systems, methods, and/or apparatuses.
Figure 22:
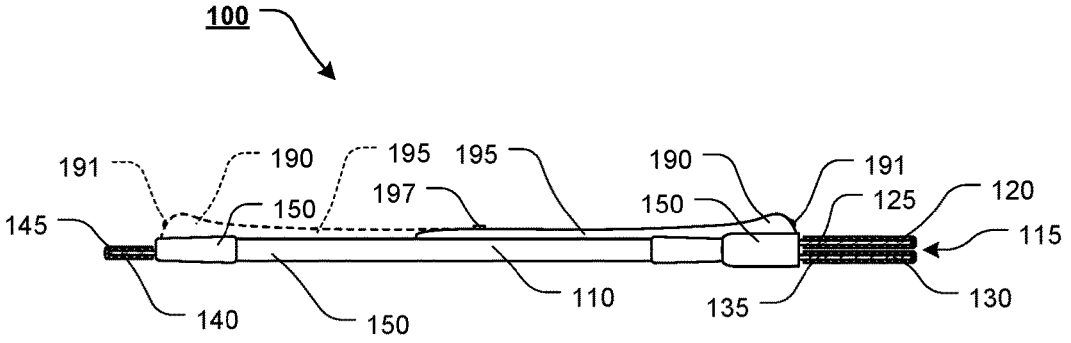
FIG. 22 illustrates a right side view of an exemplary embodiment of the connector cleaner, including a pivotable or rotatable, exemplary illumination source, according to the presently disclosed systems, methods, and/or apparatuses.

In various exemplary, nonlimiting embodiments, as illustrated in FIGS. 21-22, an illumination source 191 may also optionally be provided by the connector cleaner 100. As illustrated in FIG. 21, the illumination source 191 may comprise an illumination module 190 having an illumination source 191, such as, for example, an incandescent or light-emitting diode (LED) light source. The illumination module 190 may also include a power source (such as, for example, a battery) and a switch, which allows the illumination source 191 to be selectively illuminated or extinguished. As illustrated, a separate illumination module 190 may optionally be provided proximate the first end portion 111 and the second end portion 112 of the rod 110.

As illustrated in FIG. 22, a single illumination module 190, including an illumination module arm 195 extending from the illumination module 190 may be pivotably attached, via a pivot point or pin 197, to the rod 110. In this manner, the single illumination module 190 is rotatable such that the illumination source 191 may be selectively, rotatable between an area proximate the first end portion 111 of the rod 110 and an area proximate the second end portion 112 of the rod 110.

Thus, separate illumination modules 190 and/or devices can be provided proximate each end portion of the rod 110 or a single illumination module 190 and/or source can be provided in a stationary or rotatable position relative to the rod 110.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A connector cleaner, comprising:

an elongate portion of material extending from a first end portion to a second end portion;

a first paddle element extending from said first end portion of said elongate portion of material, wherein said first paddle element comprises a substantially planar first side surface, and wherein at least a portion of said first side surface of said first paddle element includes an abrasive element or portion;

a second paddle element extending from said first end portion of said elongate portion of material, wherein said second paddle element comprises a substantially planar first side surface, wherein at least a portion of said first side surface of said second paddle element includes an abrasive element or portion, and wherein said first side surface of said first paddle element is positioned adjacent said first side surface of said second paddle element, wherein an abrasion gap is defined between said first side surface of said first paddle element and said first side surface of said second paddle element, wherein said first paddle element and said second paddle element are formed of a biasing material, such that when said first paddle element and said second paddle element are urged apart, expanding said abrasion gap, said first paddle element and said second paddle element provide a biasing force to contract said abrasion gap; and a singular paddle element extending from said second end portion of said elongate portion of material, wherein said singular paddle element comprises a substantially planar first side surface, and wherein at least a portion of said first side surface of said singular paddle element includes an abrasive element or portion.

2. The connector cleaner of claim 1, wherein said elongate portion of material comprises a rod.

3. The connector cleaner of claim 1, wherein said abrasive element or portion comprises an abrasive portion of material attached or coupled to at least a portion of said first side surface of said first paddle element and at least a portion of said first side surface of said second paddle element.

4. The connector cleaner of claim 1, wherein said abrasive element or portion comprises an abrasive surface preparation of at least a portion of said first side surface of said first paddle element and at least a portion of said first side surface of said second paddle element.

5. The connector cleaner of claim 1, wherein said abrasive element or portion comprises an abrasive portion of material attached or coupled to at least a portion of said first side surface of said first paddle element and at least a portion of a second side surface of said first paddle element, and wherein said abrasive element or portion comprises a separate abrasive portion of material attached or coupled to at least a portion of said first side surface of said second paddle element and at least a portion of a second side surface of said second paddle element.

6. The connector cleaner of claim 1, wherein said first side surface of said first paddle element is positioned adjacent said first side surface of said second paddle element such that at least a portion of said first side surface of said first paddle element is in contact with at least a portion of said first side surface of said second paddle element.

7. The connector cleaner of claim 1, wherein said first side surface of said first paddle element is substantially parallel to said first side surface of said second paddle element.

8. The connector cleaner of claim 1, wherein said first paddle element and said second paddle element are formed of a substantially rigid or substantially semi rigid material.

9. The connector cleaner of claim 1, wherein said abrasive element or portion of said first side surface of said first paddle element comprises an abrasive element or portion that is different from said abrasive element or portion of said first side surface of said second paddle element.

10. The connector cleaner of claim 1, wherein an illumination source is disposed proximate said first end portion of said elongate portion of material.

11. The connector cleaner of claim 1, wherein an illumination source is disposed proximate said second end portion of said elongate portion of material.

12. The connector cleaner of claim 1, wherein an illumination source is disposed along said elongate portion of material and is rotatable such that said illumination source may be selectively, rotatable between an area proximate said first end portion of said elongate portion of material and an area proximate said second end portion of said elongate portion of material.

13. The connector cleaner of claim 1, wherein a cover material covers at least a portion of a surface of said elongate portion of material.

14. The connector cleaner of claim 1, wherein a substantially electrically nonconductive cover material covers said entire surface of said elongate portion of material.

15. The connector cleaner of claim 1, wherein a substantially electrically nonconductive cover material covers at least a portion of said first paddle element and said second paddle element.

16. The connector cleaner of claim 1, wherein a substantially electrically nonconductive cover material covers at least a portion of said singular paddle element.

17. A connector cleaner, comprising:

an elongate rod extending from a first end portion to a second end portion;

a first paddle element extending from said first end portion of said elongate rod, wherein said first paddle element comprises a substantially planar first side surface, and wherein at least a portion of said first side surface of said first paddle element includes an abrasive element or portion; and a second paddle element extending from said first end portion of said elongate rod, wherein said second paddle element comprises a substantially planar first side surface, wherein at least a portion of said first side surface of said second paddle element includes an abrasive element or portion, and wherein said first side surface of said first paddle element is positioned adjacent said first side surface of said second paddle element, wherein an abrasion gap is defined between said first side surface of said first paddle element and said first side surface of said second paddle element, wherein said first paddle element and said second paddle element are formed of a biasing material, such that when said first paddle element and said second paddle element are urged apart, expanding said abrasion gap, said first paddle element and said second paddle element provide a biasing force to contract said abrasion gap.

18. The connector cleaner of claim 17, wherein a substantially electrically nonconductive cover material covers at least a portion of a surface of said rod.

19. A connector cleaner, comprising:

a substantially electrically nonconductive elongate portion of material;

a first paddle element extending from a first end portion of said elongate portion of material, wherein said first paddle element comprises a substantially planar first side surface, and wherein at least a portion of said first side surface of said first paddle element includes an abrasive element or portion; and a second paddle element extending from a first end portion of said elongate portion of material, wherein said second paddle element comprises a substantially planar first side surface, wherein at least a portion of said first side surface of said second paddle element includes an abrasive element or portion, and wherein said first side surface of said first paddle element is positioned adjacent said first side surface of said second paddle element, wherein an abrasion gap is defined between said first side surface of said first paddle element and said first side surface of said second paddle element, wherein said first paddle element and said second paddle element are formed of a biasing material, such that when said first paddle element and said second paddle element are urged apart, expanding said abrasion gap, said first paddle element and said second paddle element provide a biasing force to reduce said abrasion gap.

20. The connector cleaner of claim 19, wherein said abrasive element or portion comprises an abrasive portion of material attached or coupled to at least a portion of said first side surface of said first paddle element and at least a portion of a second side surface of said first paddle element, and wherein said abrasive element or portion comprises a separate abrasive portion of material attached or coupled to at least a portion of said first side surface of said second paddle element and at least a portion of a second side surface of said second paddle element.

* * * * *